US006540383B2

(12) United States Patent
Wu

(10) Patent No.: US 6,540,383 B2
(45) Date of Patent: Apr. 1, 2003

(54) DISASSEMBLY-TYPE LAMP SHADE STRUCTURE

(76) Inventor: Wen-Chang Wu, No. 10, Lane 191, Hsi Hsin Street, Chuang Ya Tsun, Hsiu Shui Hsiang, Chang Hua Hsien (TW)

( * ) Notice: Subject to any disclaimer, the term of this patent is extended or adjusted under 35 U.S.C. 154(b) by 0 days.

(21) Appl. No.: 09/752,739

(22) Filed: Jan. 3, 2001

(65) Prior Publication Data

US 2002/0085383 A1 Jul. 4, 2002

(51) Int. Cl.[7] ..... F21V 17/00
(52) U.S. Cl. ..... 362/450; 362/352
(58) Field of Search ..... 362/351, 352, 362/355, 356, 358, 360, 361, 434, 450

(56) References Cited

U.S. PATENT DOCUMENTS 2,884,515 A * 4/1959 Fogel ..... 362/358
3,022,417 A * 2/1962 Linderoth ..... 362/358
3,023,307 A * 2/1962 Okamoto ..... 362/352
4,688,155 A * 8/1987 Huang ..... 362/358
4,751,625 A * 6/1988 Lin ..... 362/352

* cited by examiner

*Primary Examiner*—Y. My Quach-Lee
(74) *Attorney, Agent, or Firm*—Troxell Law Office PLLC

(57) ABSTRACT

A disassembly-type lamp shade structure of simple assembly and reduced physical dimensions includes a top ring, a bottom ring of larger circumference than the top ring, and frame members propped between the top ring and the bottom ring. The top ring has support rods extending outwardly from the center having at their extremities upward bends forming insertion hooks. The bottom ring has sleeve mounts for the insertion of the frame members, after which the upper horizontal curved rods of the frame members are situated against the insertion hooks at the extremities of the support rods and lower horizontal curved rods are situated against the bottom ring, thereby positioning and limiting the movement of the frame members. At the area of confluence between the frame member upper horizontal curved rods and the support rods, the upper horizontal curved rods have downward indentations serving as a catch hook that secures the insertion hook.

4 Claims, 7 Drawing Sheets

DISASSEMBLY-TYPE LAMP SHADE STRUCTURE

BACKGROUND OF THE INVENTION

1) Field of the Invention

The invention herein relates to a disassembly-type lamp shade structure in which the top ring has support rods extending from the center towards its circumference, the support rods each having at an extremity an upward bend to form an insertion hook. After the frame members re inserted into the bottom ring sleeve mounts, indentations serving as catch hooks formed by downward bending along the upper horizontal curved rods of the frame members at the area of confluence between the frame member horizontal curved rods and support rods secures the insertion hooks, thereby fixing the position of the frame members such that when packaged, the frame members must be first removed and laid flat so the lamp shade occupies the smallest physical assembly space to facilitate ease of assembly and, furthermore, the resulting minimized storage area effectively reduces shipping costs.

2) Description of the Prior Art

A conventional lamp shade 5, referring to FIG. 6, typically has its frame members permanently fixed between the top ring and the bottom ring to form a lamp shade structure; however, since its structure is imperfect, the numerous practical shortcomings that result include the following example.

Since the conventional lamp shape 5 is a structural entity of an unyielding shape, when it is packaged in a carton, the lamp shade 5 cannot be forcefully diminished in size and no reduction in large volume storage area is possible, which leads to a proportional increase in product shipping costs and results in greater overhead.

In view of the said shortcomings, the inventor of the invention herein conducted extensive research that culminated in the successful development of a disassembly-type lamp shade structure that entirely eliminates the drawbacks of the conventional product.

SUMMARY OF THE INVENTION

The primary objective of the invention herein is to provide a disassembly-type lamp shade structure comprised of a top ring, a bottom ring, and frame members propped between the top ring and the bottom ring, wherein the top ring has support rods extending from the center towards its circumference and, furthermore, the support rods each have at an extremity an upward bend to form a insertion hook. The bottom ring has respectively disposed at the support positions of the frame members sleeve mounts that provide for the insertion of the frame members, after which the upper horizontal curved rods of the frame members are situated against the insertion hooks at the extremities of the support rods and the lower horizontal curved rods are situated against the bottom ring, thereby positioning and limiting the movement of the frame members; and, at the area of confluence between the frame member upper horizontal curved rods and the support rods, the upper horizontal curved rods have formed by downward bending an indentation serving as a catch hook that secures the insertion hook, thereby fixing the position of the frame members; when packaged, the frame members must be first removed and laid flat such that lamp shade of the present invention occupies the smallest physical assembly space to facilitate ease of assembly and, furthermore, the resulting minimized storage area effectively reduces shipping costs.

Another objective of the invention herein is to provide a disassembly-type lamp shade structure in which the bottom ring has respectively disposed at the support positions of the frame member sleeve mounts, each of the sleeve mounts projecting upwardly with a keeper hole that provides for the fixed insertion of one of the frame members and, furthermore, after the frame member insert posts are slipped into the sleeve mounts, the sleeve mount keeper holes retain them by an integrated press-fit lock annulus; and furthermore, the two sides of the bottom ring annular rod-like body to which each sleeve mount is conjoined are punch flattened such that after punch flattening, the stop nubs thereby formed position and limit the movement of the sleeve mounts.

To enable the examination committee a further understanding of the present invention, the brief description of the drawings below is followed by the detailed description of the invention herein.

DETAILED DESCRIPTION OF THE INVENTION

Figure 1:
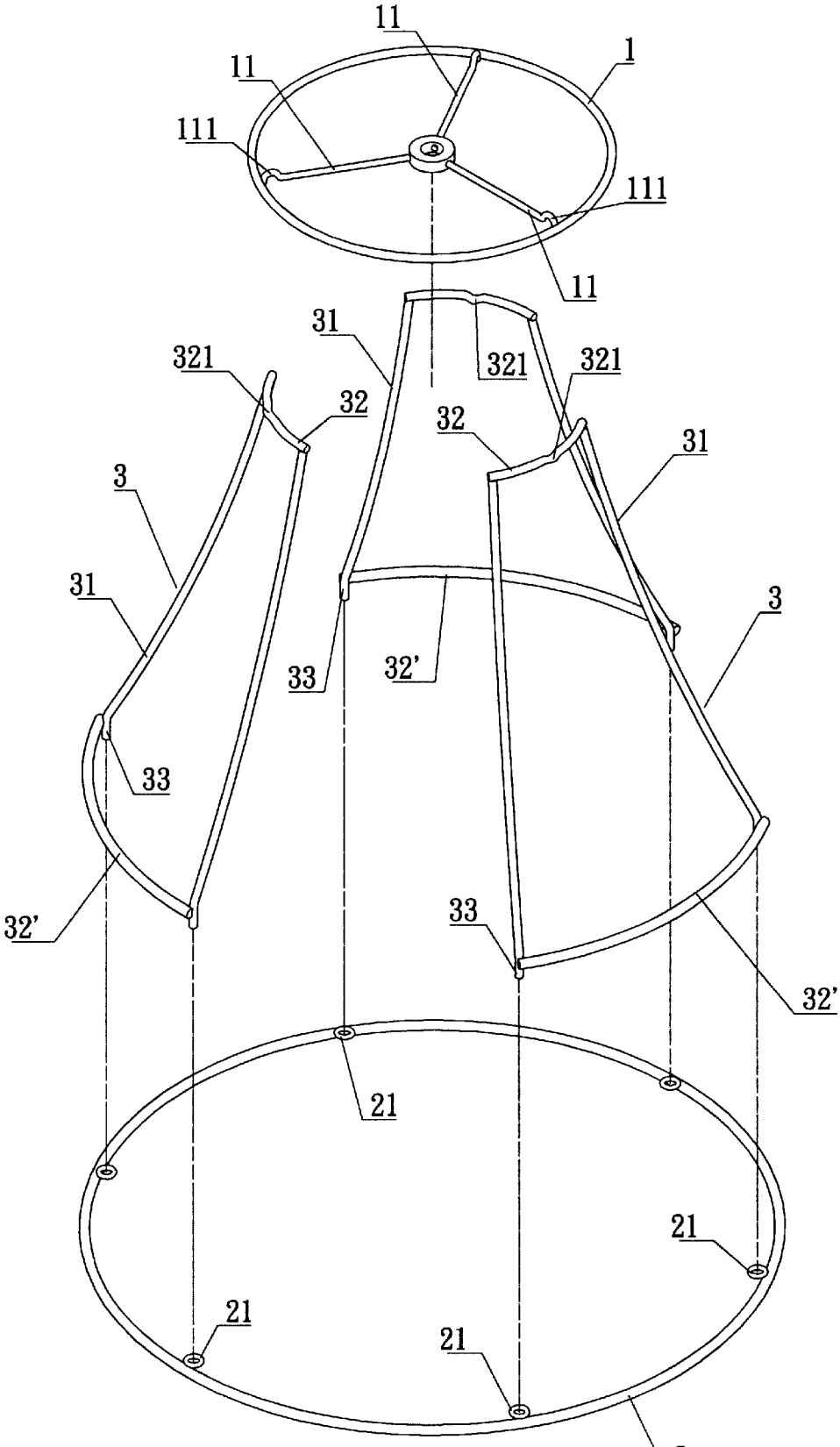
FIG. 1 is an exploded drawing of the invention herein.
Figures 2, 2A:
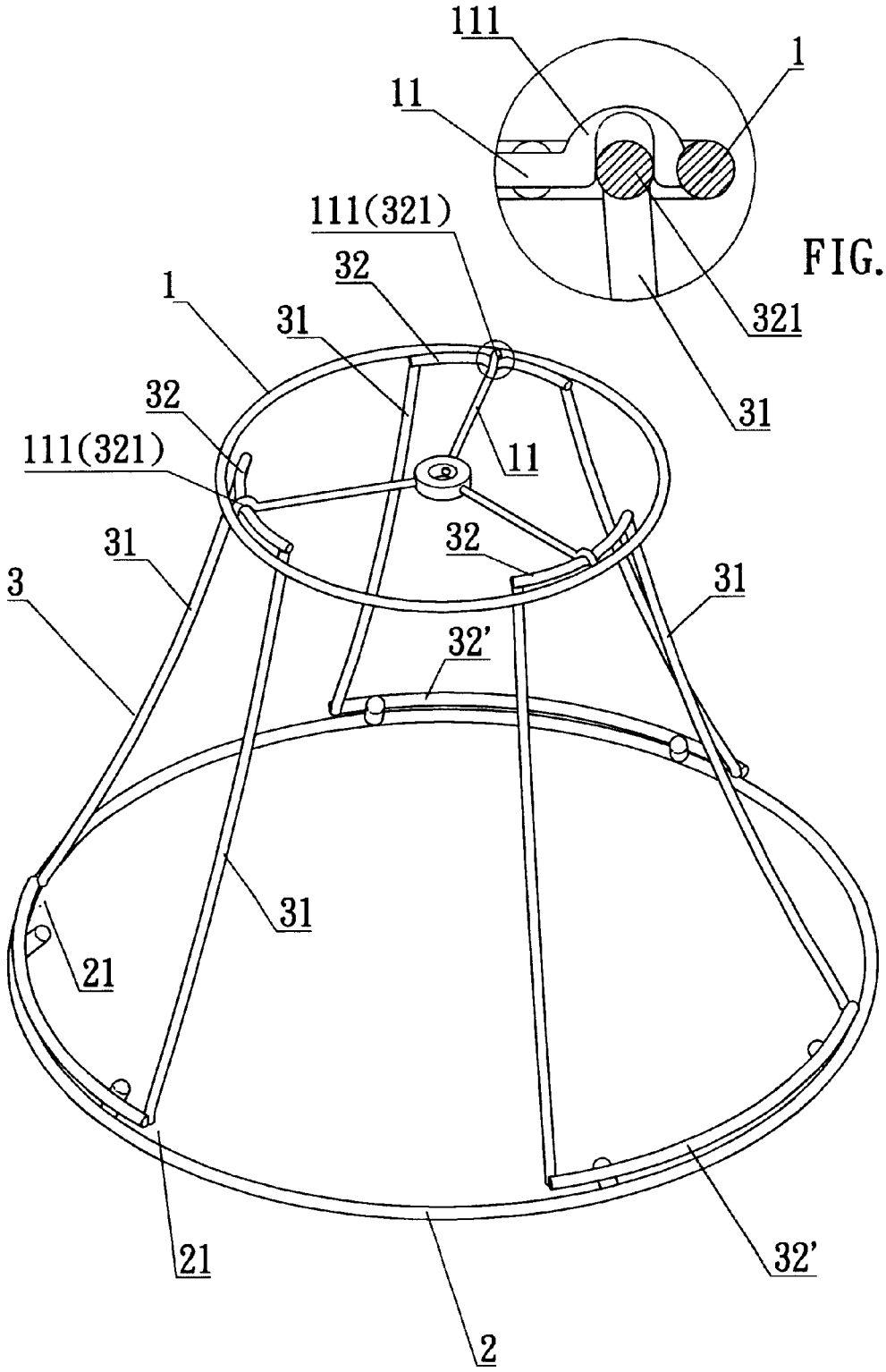
FIG. 2 is an isometric drawing of assembled invention herein.
FIG. 2A is an orthographic drawing of the support section at the top ring and a frame member, as shown in a magnified view.

Referring to FIG. 1 and FIG. 2, the drawings of the structural arrangement of the present invention, the invention herein is comprised of a top ring 1 situated at the uppermost end of a lamp shade, a bottom ring 2 of larger circumference than the top ring 1, and frame members 3 propped between the top ring 1 and the bottom ring 2; of which:

The said top ring 1 is of annular metal constructions and, furthermore, is placed against the columnar lamp pipe structure, with the top ring 1 having support rods 11 extending from the center towards its circumference and, furthermore, the support rods 11 each have at an extremity an upward bend to form an insertion hook 111 that is fixed onto the circumference of the top ring 1, thereby providing for the placement and the engaged positioning of the frame members 3.

The said bottom ring 2 has respectively disposed at the support positions of the frame members 3 sleeve mounts 21 that provide for the insertion of the frame members 3.

The said frame members 3 consist of left and right vertical curved rods 31 and coordinated upper and lower horizontal curved rods 32 and 32', with the degree of curvature of the upper horizontal rods 32 matching that of the top ring 1 and the degree of curvature of the lower horizontal rods 32' matching that of the bottom ring 2; at the area of confluence between the frame member 3 upper horizontal curved rods 32 and the support rods 11, the upper horizontal curved rods 32 have formed by downward bending an indentation serving as a catch hook 321 that secures the insertion hook 111, thereby fixing the position of the frame members 3; the frame member 3 bottom ends are bent so they meet with the bottom ring 2 in a perpendicular arrangement and, furthermore, the insert posts 33 thereby formed are capable of being slipped into the bottom ring 2 sleeve mounts 21 such that after the frame member 3 insert posts 33 are slipped into the sleeve mounts 21, the upper horizontal curved rods 32 are situated against the insertion hooks 111 at the extremities of the support rods 11 and the lower horizontal curved rods 32' are situated against the bottom ring 2, thereby positioning and limiting the movement of the frame members 3.

Figure 3:
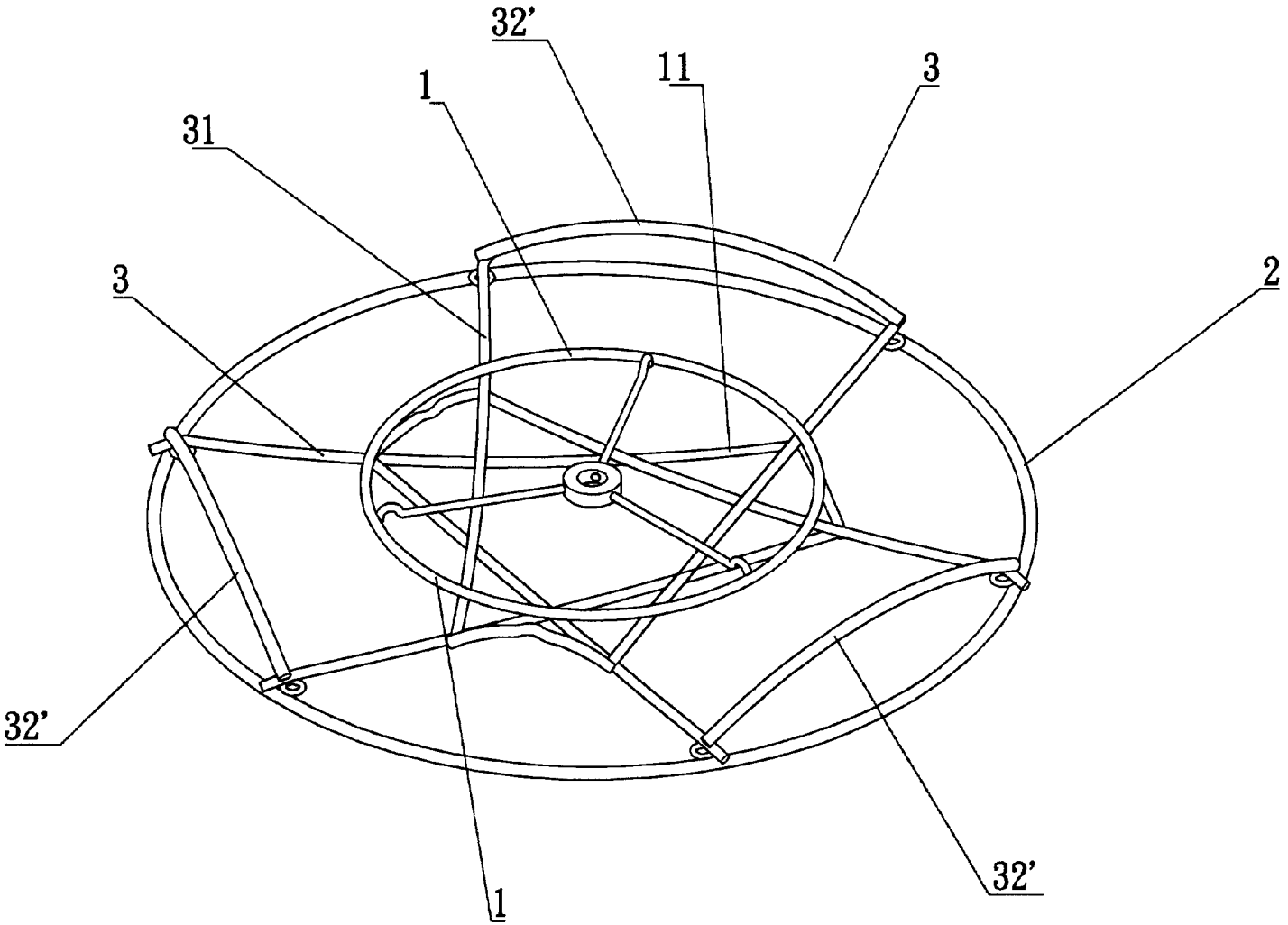
FIG. 3 is an isometric drawing of the invention herein in the folded state.

Referring to FIG. 3, the drawing depicting the invention herein in the folded state, when packaged, the frame members 3 must be first removed and laid flat such that lamp shade of the present invention occupies the smallest physical assembly space to facilitate ease of assembly and, furthermore, the resulting minimized storage area effectively reduces shipping costs.

Figure 4:
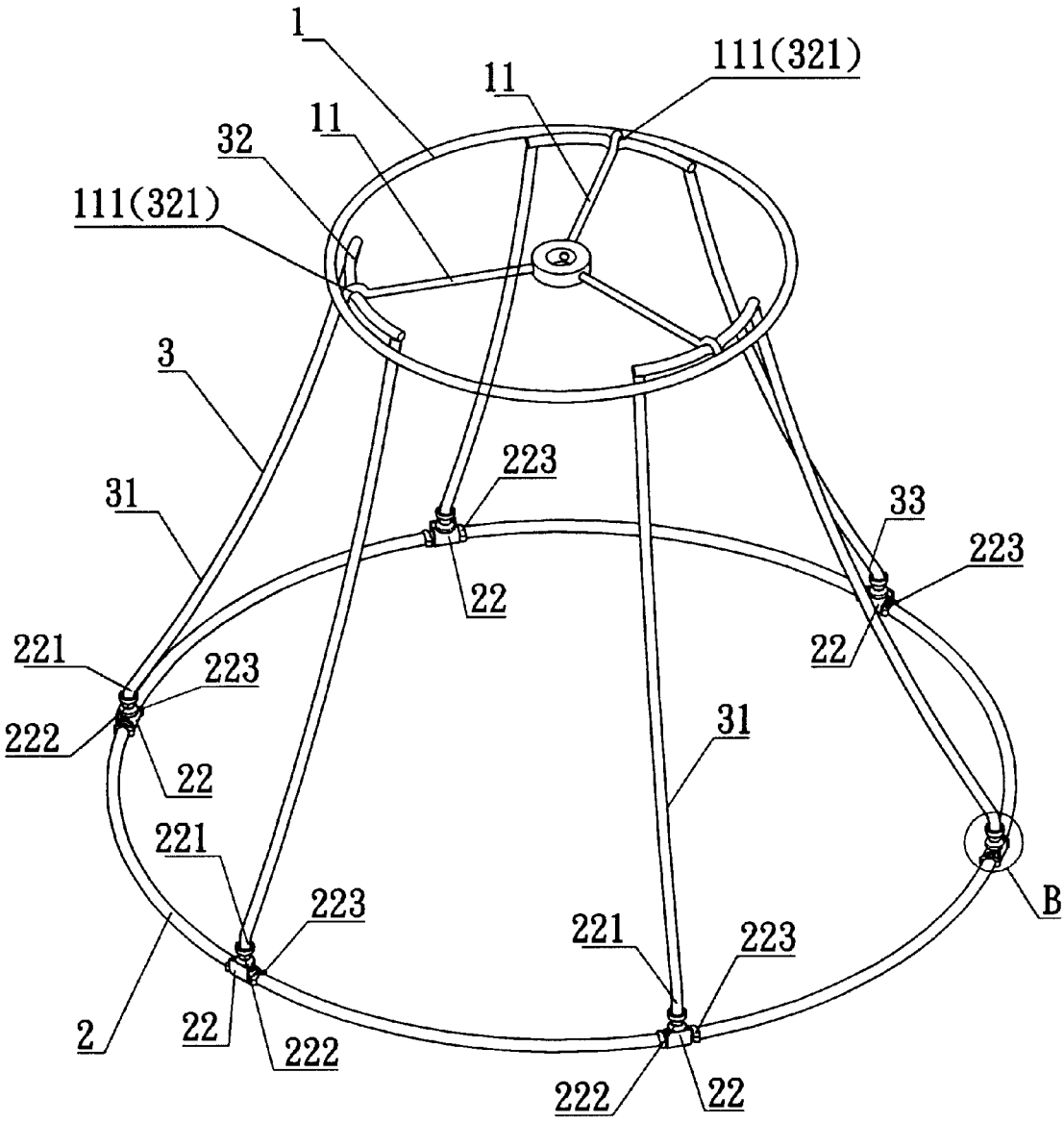
FIG. 4 is an isometric drawing of another embodiment of the invention herein.
Figure 4B:
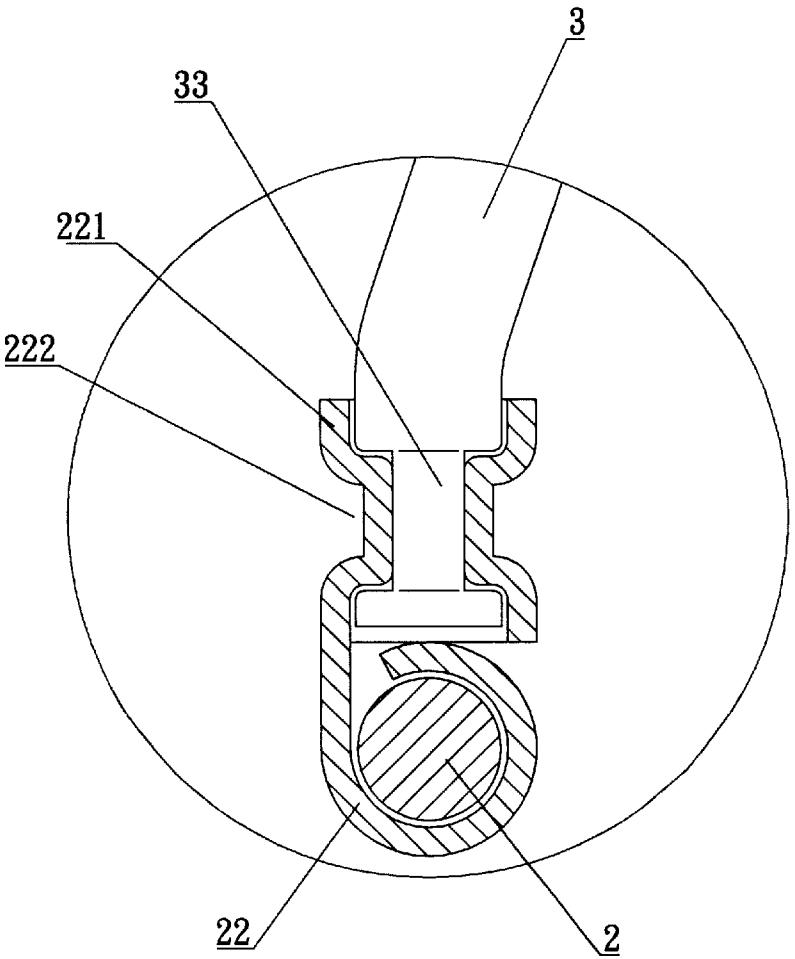
FIG. 4B is a cross-sectional drawing of the sleeve mount and frame member assembly.
Figure 4A:
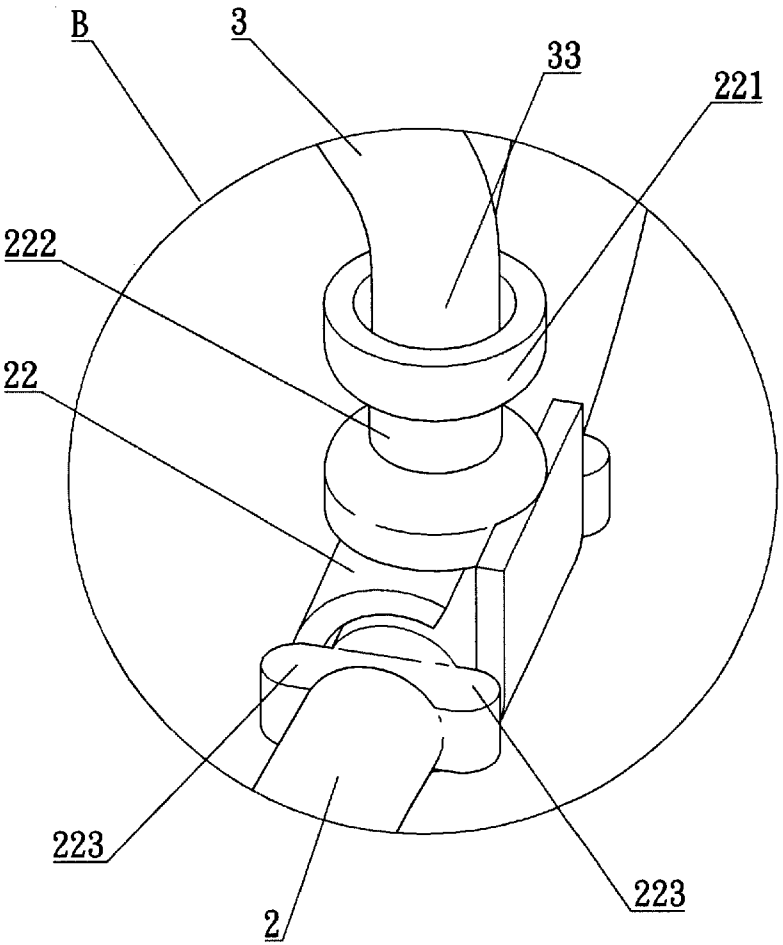
FIG. 4A is an isometric drawing of the insertion section at the sleeve mount and a frame member, as shown in a magnified view.

Referring to FIG. 4, the drawing of another embodiment of the invention herein, the said frame members 3 consists of left and right vertical curved rods 31 and coordinated upper horizontal curved rods 32; the bottom ring 2 has respectively disposed at the support positions of the frame member 3 sleeve mounts 22, the sleeve mounts 22 each having a projecting upward keeper hole 221 that provides for the fixed insertion of one of the frame members 3 and, furthermore, after the frame member 3 insert posts 33 are slipped into the sleeve mounts 22, the sleeve mount 22 keeper holes 221 retain them by an integrated press-fit lock annulus 222; and furthermore, the two sides of the bottom ring 2 annular rod-like body to which sleeve mounts 22 are conjoined are punch flattened such that after punch flattening, the stop nubs 223 thereby formed position and limit the movement of the sleeve mount 22.

Figures 5, 5A:
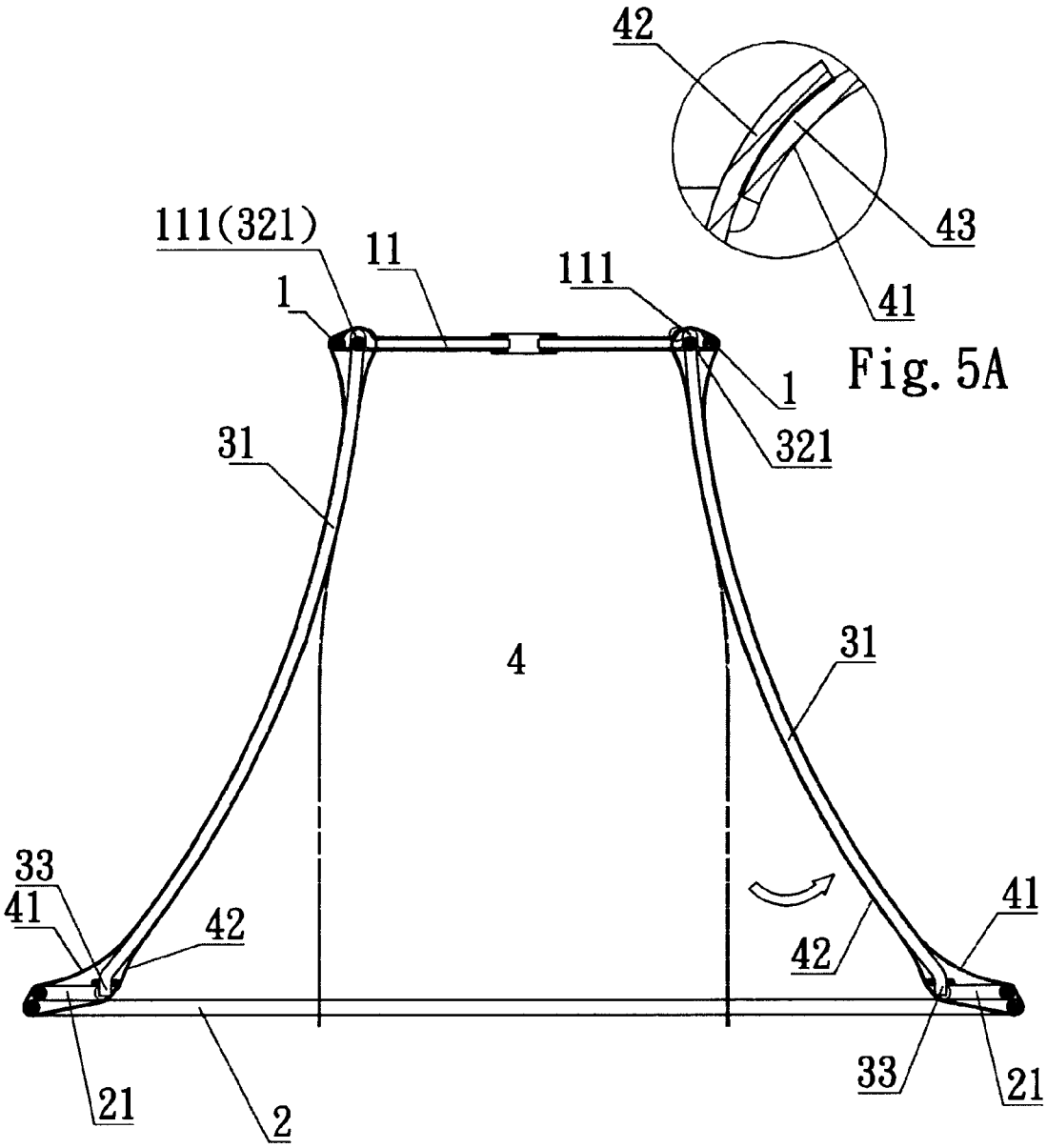
FIG. 5 is a cross-sectional drawing of the assembled lamp shade of the invention herein.
FIG. 5A is a cross-sectional drawing of the adhesion section, as shown in a partial magnified view.
Figure 6:
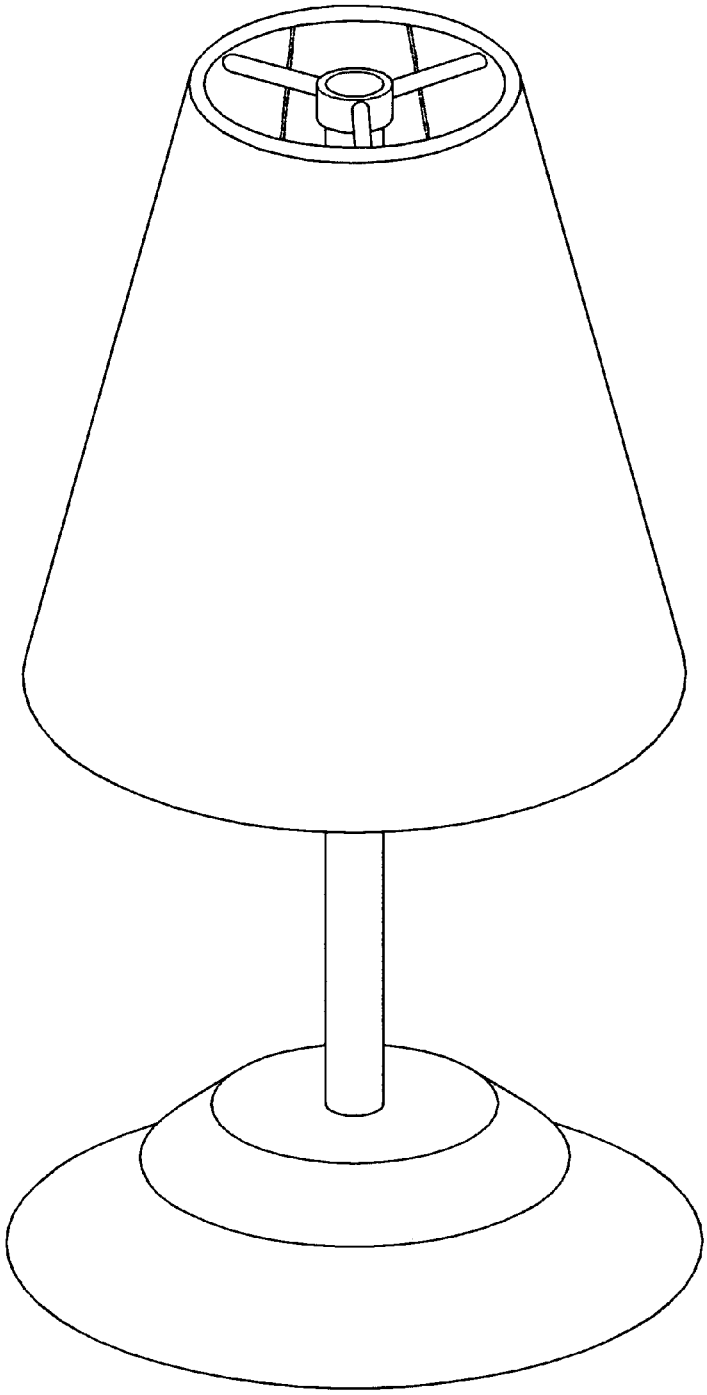
FIG. 6 is an isometric drawing of a conventional lamp shade.

Referring to FIG. 5, after the assembly of the said lamp shade is completed, the top ring 1 and the bottom ring 2 are wrapped in an enshrouding fabric material lamp shade 4, wherein an exterior fabric surface layer 41 of the said lamp shade 4 is first tightly fitted onto the outer periphery of the frame members 3; additionally, an interior fabric surface layer 42 is placed along the inner sides of the frame members 3 and, furthermore, an adhesive fastening tape 43 is respectively applied over an appropriate area of the interior fabric surface layer 42 and the exterior fabric surface layer 41, the frame members 3 are enveloped within such that the frame members 3 remain unexposed due to the ensconcing structural arrangement constituted by the interior fabric surface layer 42 and the exterior fabric surface layer 41, while also effectively achieving an attractive appearance; and, when the frame is folded, the attached lamp shade 4 collapses along with it to achieve a reduction in material storage area and thereby effectively lower shipping costs.

In summation of the foregoing section, the disassembly-type lamp shade structure of the invention herein is capable of achieving all of the claimed objectives.

What is claimed is:

1. A disassembly-type lamp shade structure comprised of a top ring situated at an uppermost end of a lamp shade, a bottom ring situated at a bottommost end of said lamp shade, and a plurality of frame members propped between said top ring and said bottom ring; said top ring having a plurality of support rods extending from a center of said top ring toward a circumference of said top ring, each of said support rods having at its extremity an upward bend forming an insertion hook and fixed onto the circumference of said top ring; said bottom ring having a plurality of sleeve mounts respectively disposed at a plurality of support positions of said frame members; each of said frame members including left and right vertical curved rods and coordinated upper and lower horizontal curved rods; a curvature of each of said upper horizontal curved rods corresponding to a curvature of said top ring and a curvature of each of said lower horizontal curved rods corresponding to a curvature of said bottom ring; each of said upper horizontal curved rods having downward bending indentation forming a catch hook that secures said insertion hook at the area of confluence between said upper horizontal rod and said support rod; wherein a bottom end of each of said vertical curved rods is bent to form an insertion post such that said bottom end meets with said bottom ring in a perpendicular arrangement; and said insertion posts being slipped into said sleeve mounts such that after said insertion posts are slipped into said sleeve mounts, said upper horizontal curved rods are situated against said insertion hooks at the extremities of said support rods and said lower horizontal curved rods are situated against said bottom ring.

2. A disassembly-type lamp shade structure of claim 1, wherein said lamp shade is an enshrouding fabric material, said top ring and said bottom ring are wrapped in said fabric material, an exterior fabric surface layer of said lamp shade is tightly fitted onto outer sides of said frame members and an interior fabric surface layer is placed along said inner sides of said frame members, an adhesive fastening tape is respectively applied over an appropriate area between said exterior fabric surface layer and said interior surface layer such that said exterior surface layer and said interior surface layer form an ensconcing structural arrangement.

3. A disassembly-type lamp shade structure comprised of a top ring situated at an uppermost end of a lamp shade, a bottom ring formed of a plurality of annular rod-like bodies and situated at a bottommost end of said lamp shade, and a plurality of frame members propped between said top ring and said bottom ring; said top ring having a plurality of support rods extending from a center of said top ring toward a circumference of said top ring, each of said support rods having at its extremity an upward bend forming an insertion hook and fixed onto the circumference of said top ring; said bottom ring having a plurality of sleeve mounts respectively disposed at a plurality of support positions of said frame members; each of said sleeve mounts having a projecting upward keeper hole providing for a fixed insertion of said frame member, each of said frame members including left and right vertical curved rods and upper and horizontal curved rod, each of said upper horizontal curved rods having downward bending indentation forming a catch hook that secures said insertion hook at the area of confluence between said upper horizontal curved rod and said support rod; wherein a bottom end of each of said vertical curved rods is bent to form an insertion post such that said bottom end meets with said bottom ring in a perpendicular arrangement; and said insertion posts being slipped into said sleeve mounts such that after said insertion posts are slipped into said sleeve mounts, each of said keeper holes retains said insertion post by an integrated press-fit lock annulus; each of said annular rod-like bodies having opposite ends punch flattened to form stop nubs, and wherein each of said sleeve mounts is conjoined to adjacent ends of said annular rod-like bodies such that said stop nubs of adjacent rod-like bodies limit the movement of said sleeve mount.

4. A disassembly-type lamp shade structure of claim 3, wherein said lamp shade is an enshrouding fabric material, said top ring and said bottom ring are wrapped in said fabric material, an exterior fabric surface layer of said lamp shade is tightly fitted onto outer sides of said frame members and an interior fabric surface layer is placed along said inner sides of said frame members, an adhesive fastening tape is respectively applied over an appropriate area between said exterior fabric surface layer and said interior surface layer such that said exterior surface layer and said interior surface layer form an ensconcing structural arrangement.

* * * * *